US005573213A

United States Patent [19]

Henderson et al.

[11] Patent Number: 5,573,213

[45] Date of Patent: Nov. 12, 1996

[54] WALKER GLIDE

[76] Inventors: Richard E. Henderson; Kathleen O'Brien, both of 107 Whispering Sands Cir., Sarasota, Fla. 34242

[21] Appl. No.: 426,970

[22] Filed: Apr. 24, 1995

[51] Int. Cl.[6] ..... A47B 91/06

[52] U.S. Cl. ..... 248/188.9; 248/46.11; 135/67; 135/77; 135/86; 16/42 R

[58] Field of Search ..... 135/67, 66, 77, 135/84, 86; 248/188.9, 345.1, 346.11; D8/374; 16/42 R

[56] References Cited

U.S. PATENT DOCUMENTS

| | | | |
|---|---|---|---|
| D. 340,638 | 10/1993 | Campbell | D8/374 |
| 1,516,573 | 11/1924 | Noelting et al. | 16/42 R |
| 1,870,120 | 8/1932 | Humes | 248/22 |
| 1,982,138 | 11/1934 | Herold | 248/346.11 |
| 1,988,377 | 1/1935 | Fruchter | 248/346.11 |
| 2,633,599 | 3/1953 | Dolan | 16/42 R |
| 2,738,541 | 3/1956 | Thornsbury | D8/374 X |
| 3,025,631 | 3/1962 | Reynolds | 248/188.9 |
| 3,531,090 | 9/1970 | Laible | 52/736.1 |
| 3,883,923 | 5/1975 | England | 248/188.9 X |
| 4,327,461 | 5/1982 | Wisniewski | 248/188.9 X |
| 4,562,851 | 1/1986 | Frank | 135/84 X |
| 5,191,676 | 3/1993 | Gerner | 16/42 R X |
| 5,224,506 | 7/1993 | Allen et al. | 135/67 |

FOREIGN PATENT DOCUMENTS

| | | | |
|---|---|---|---|
| 83572 | 7/1964 | France | 248/188.9 |
| 1597343 | 9/1981 | United Kingdom | 16/42 R |

*Primary Examiner*—Wynn E. Wood
*Assistant Examiner*—Aimee E. McTigue
*Attorney, Agent, or Firm*—Charles J. Prescott

[57] ABSTRACT

A self-retaining glide for the lower end of each leg of a walker. Preferably installed onto each rear leg of the walker, the device decreases forward drag while substantially increasing resistance to sideways or lateral movement by providing a plurality of downwardly facing or extending parallel ground, floor and carpet engaging fins. These fins are a molded part of an elongated main member which also includes one and preferably two spaced apart tubular supports for retaining the device in proper position on the leg lower end. In the preferred embodiment, the combination of snugly fitting tubular supports on the leg and resilient flexing of a semi-rigid central portion of the main member from a flat to a U-shape securely maintains the fins in a fore/aft orientation with respect to the walker after proper installation.

3 Claims, 1 Drawing Sheet

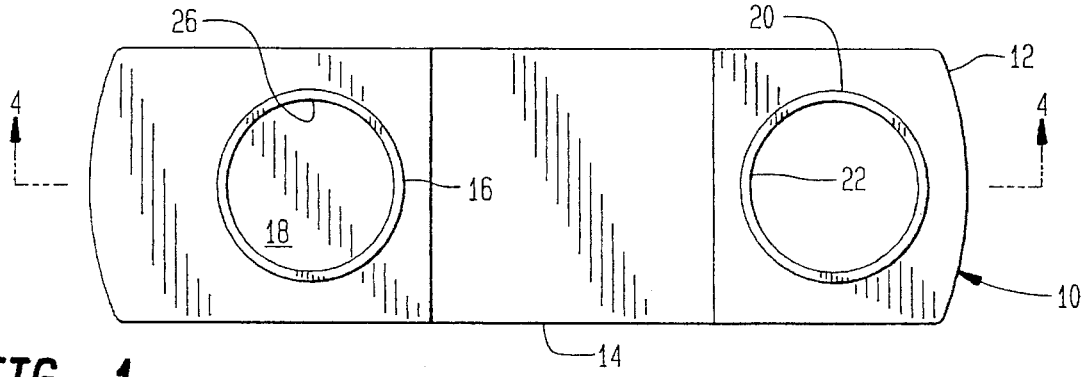
FIG. 1
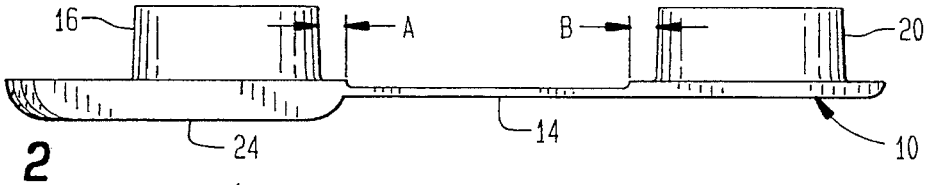
FIG. 2
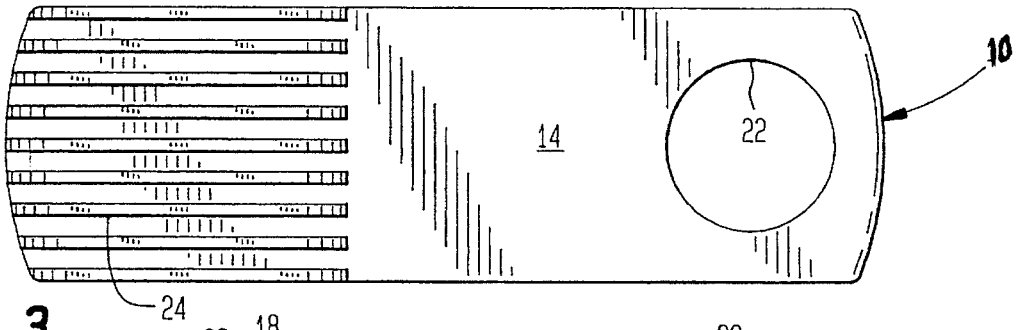
FIG. 3
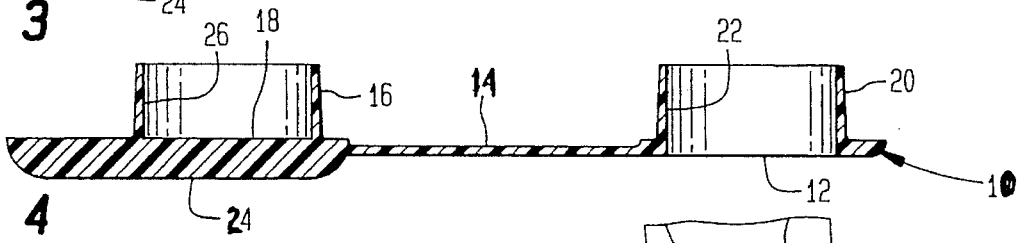
FIG. 4
FIG. 5
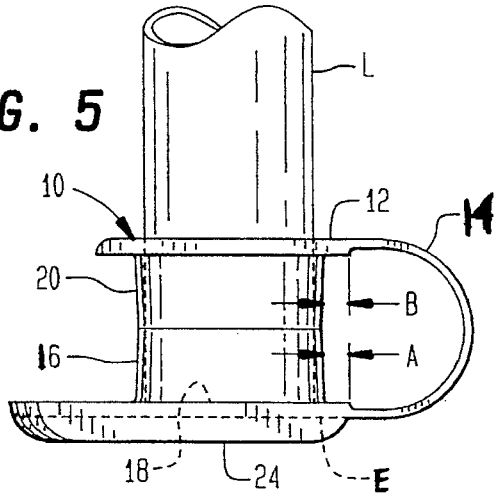
FIG. 6
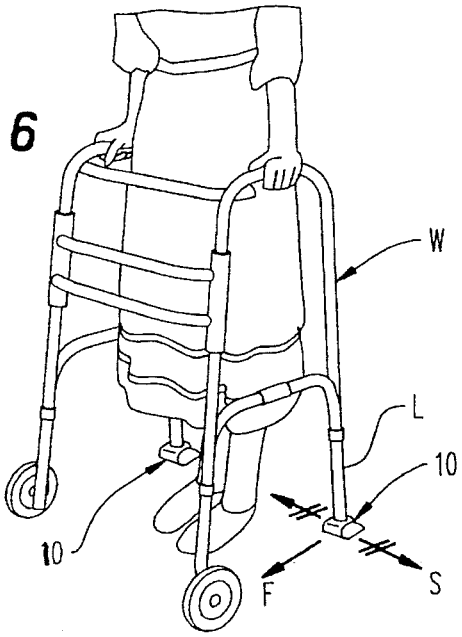

WALKER GLIDE

BACKGROUND OF THE INVENTION

1. Scope of Invention

This invention relates generally to walkers used by handicapped individuals and those weakened or recovering from injury and particularly to a glide connectable onto the lower leg of a walker for improved performance and stability.

2. Prior Art

Walkers are well known products available for the permanently handicapped and those individuals weakened or recovering from injury particularly to lower limbs. Used in lieu of crutches, canes or other ambulatory aids, a walker provides considerably more stability for the individual by providing four spaced apart legs in a rectangular pattern for inherent upright stability and tip resistance.

In using a walker, the individual grasps upper horizontal side handles or support members of the walker to receive leaning support during each stride or step taken. In between each stride, the individual then lifts the walker from the floor, ground or support surface or simply removes body weight sufficiently to slide or move the walker forward or rearward in preparation for the next stride taken.

Conventional walkers are manufactured with rubber or plastic caps fitted onto the lower ends of each leg. The legs themselves are typically manufactured from aluminum tube for strength and lightness. These caps provide wear resistance while minimizing scratching and wearing of the support surface and further, when made of an anti-skid material such as rubber, increase the stability provided by the walker during each stride and while being supporting a stationary user.

Ideally, the ease with which an individual utilizes the walker is enhanced where resistance to forward movement or drag in between each stride is minimized. To accomplish this, prior art discloses an alternative to the caps in the form of wheels positioned onto the lower ends of either or both forward and rear legs of walkers. Typically, when forward wheels are utilized, they are mounted on rigid axles for rolling movement only. Alternately, when positioned at the lower ends of the rear legs, the wheels may either be fixed for rotation only or also allowed to turn about an upright axis for turning maneuvers.

Generally, lateral movement of the walker during use is undesirable as it typically represents movement which decreases the overall stability of the individual using the walker. Thus, caps provided at the lower ends of the legs, while perhaps providing some increase in lateral drag, provide that same increase in forward drag, an undesirable result. Likewise, rear wheels in lieu of caps which turn or pivot about an upright axis, while increasing maneuverability, also decrease lateral stability.

The present invention provides a glide fitable onto the lower ends of preferably the rear legs of a walker which substantially reduces forward drag or resistance to forward movement while substantially increasing the lateral stability or side-to-side resistance to movement.

BRIEF SUMMARY OF THE INVENTION

This invention is directed to a self-retaining glide for the lower end of each leg of a walker. Preferably installed onto each rear leg of the walker, the device decreases forward drag while substantially increasing resistance to sideways or lateral movement by providing a plurality of downwardly extending parallel ground, floor and carpet engaging fins. These fins are a molded part of an elongated generally flat main member which also includes one and preferably two spaced apart tubular supports for retaining the device in proper position and alignment on the leg lower end. In the preferred embodiment, the combination of snugly fitting tubular supports on the leg and resilient flexing pressure from a semi-rigid central portion of the main member from a flat to a U-shape securely maintains the fins in a fore/aft orientation with respect to the walker after proper installation.

It is therefore an object of this invention to provide a glide for the lower ends of the legs of a walker which will substantially reduce the forward drag against the support surface during use.

It is another object of this invention to provide a glide for the lower end of the rear legs of a walker which substantially decreases the tendency for lateral or sideways movement of the walker.

It is another object of this invention to provide a glide for the lower end of legs of a walker which is self-retaining after installation without the need for other fasteners or adhesives for securement.

It is another object of this invention to provide a glide for the lower end of legs of a walker in various sizes to accommodate virtually any walker leg diameter.

In accordance with these and other objects which will become apparent hereinafter, the instant invention will now be described with reference to the accompanying drawings.

BRIEF DESCRIPTION OF THE DRAWINGS

FIG. 1 is a top plan view of the invention.

FIG. 2 is a side elevation view of FIG. 1.

FIG. 3 is a bottom plan view of FIG. 1.

FIG. 4 is a section view in the direction of arrows 4—4 in FIG. 1.

FIG. 5 is a side elevation view of the invention of FIG. 1 in its installed configuration at the lower end of the leg of a walker.

FIG. 6 is a perspective view of the invention positioned for use onto the lower ends of the rear legs of a walker.

DETAILED DESCRIPTION OF THE INVENTION

Referring now to the drawings, the preferred embodiment of the invention is shown generally at numeral 10 in the figures. The glide 10 is manufactured of integrally molded plastic such as polyethylene having a main member 12 generally elongated and flat in configuration. Two tubular support members 16 and 20 are orthogonally disposed from one common surface of the main member 12 and are sized in diameter at 22 and 26 to snugly fit onto the lower leg L of a walker shown generally at W.

Tubular support member 20 is entirely open at each end thereof while tubular support member 16 is closed at bottom 18 defined by a portion of the one surface of main member 12. The purpose for this structure will be clarified herebelow.

Orthogonally extending from one end of the opposite surface of main member 12 are a plurality of spaced, parallel fins 24. When properly aligned during installation to be longitudinal or fore-and-aft with respect to the walker W, these fins 24 serve to both reduce forward drag or resistance to movement of the walker while increasing the lateral or side-to-side resistance to inadvertent sideways movement. Thus, as best seen in FIG. 6 where the invention 10 is installed onto each rearward leg L of the walker W, forwardly movement in the direction of arrow F is enhanced wherein the fins 24 reduce friction or drag against the support surface such as the ground, a floor or carpet, while increasing the amount of resistance to lateral or sideways movement in the direction of arrows S.

The main member 12 includes a thinned central portion 14 which renders this central portion 14 to be semi-rigid or somewhat resiliently flexible in nature. By terminating this central portion 14 equidistant amounts A and B from the facing surfaces of support tubes 16 and 20 as best seen in FIGS. 2 and 5, an important uniform bending characteristic of the invention is provided. For economy and manufacturing practicality, the invention 10 is molded in the flat as shown in FIGS. 1 to 4. Upon installation, the main member 12 is flexed or bent back upon itself through arcuate flexure of the central portion 14 into the configuration shown in FIG. 5. Because the central portion 14 is uniformly offset in equal amounts at A and B from the support tubes 16 and 20, when this flexure occurs, the distal ends of the support members 16 and 20 automatically align one to another so that their inner cylindrical openings 22 and 26 are generally coaxial without undue additional manipulation. This built-in tendency thus facilitates installation of the device 10 onto the lower end of the leg L. When fully installed, the lower end E of leg L thus butts against bottom 18 of support member 16.

As may now be better understood, two important aspects of the present invention 10 in its preferred embodiment act toward self-retention of the device 10 without the need for adhesives or mechanical fastening devices. First, two cylindrical holes 22 and 26 are sized for relatively tight, snug, somewhat forced slidable fit over the outer diameter of the lower leg L which is typically fabricated of aluminum tubing. Various sizes of the invention with respect to these cylindrical holes 22 and 26 are provided for adapting the device 10 to virtually all tube sizes utilized in the manufacture of walkers generally. The second aspect of retention is the biasing force exerted after the central portion 14 is arcuately flexed into the installed configuration in FIG. 5. The molded plastic material utilized, typically polyethylene, has sufficient resiliency to produce the biasing back toward the flat, molded configuration of FIGS. 1 to 4.

An alternate embodiment of the invention would include only a portion of the main member 12 which extends to include and dependently support the support member 16 and fins 24. Thus, the central portion 14 and the support tube 20 would be removed from this alternate embodiment. In such case, the retention qualities of this embodiment would be dependent upon the tight fitting nature of cylindrical hole 26 onto the lower end of the leg L.

In either embodiment of the invention, the longitudinal fins 24 must be aligned and maintained in alignment in the fore-and-aft direction with respect to the forwardly direction of movement of the walker W.

Although the preferred location for the glides 10 is at both rear legs L of the walker W, certainly positioning these glides 10 onto the lower ends of the front legs of the walker W would be within the intended scope of the invention and should not be viewed as in any way limiting with respect to the claims contained herein.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A self-retaining glide for a lower end of each rear leg of a walker comprising:

a molded elongated main member having first and second spaced tubular supports extending orthogonally from one surface of said main member;

said first and second tubular supports each sized in diameter for snug slidable engagement onto the lower end of the leg;

said first tubular support open at each end thereof and positioned adjacent a first end of said main member, said second tubular support open at a distal end thereof and having a closed bottom end defined by a portion of said one surface adjacent a second end of said main member;

a plurality of spaced parallel elongated fins positioned and extending orthogonally from another surface of said main member opposingly from said second tubular support;

said plurality of fins defining a lower ground or carpet engaging surface;

said main member having a semi-flexible central portion between said first and second tubular supports whereby, said first tubular support is slidably positionable onto the rear leg and spaced upwardly from the lower end, and said central portion is resiliently flexed into a generally U-shape, said second tubular support is slidably positionable onto the lower end of the leg to secure said glide for use, said plurality of fins being generally aligned fore-and-aft with respect to the walker.

2. A self-retaining glide connectable to a lower end of a leg of a walker comprising:

an elongated generally flat main member having first and second spaced tubular supports extending orthogonally from a first surface of said main member;

said first and second tubular supports each sized in diameter for snug slidable engagement onto the lower end of the leg;

said first tubular support open at each end thereof and positioned adjacent a first end of said main member, said second tubular support open at a distal end thereof and having a closed bottom end defined by a portion of said first surface adjacent a second end of said main member;

a plurality of spaced parallel elongated fins positioned and extending orthogonally from a second surface of said main member opposingly from said second tubular support;

said plurality of fins defining a lower ground or carpet engaging surface;

said main member having a semi-flexible central portion between said first and second tubular supports which, when flexed into a generally U-shape, positions said first and second tubular supports end-to-end in coaxial alignment ready for installation onto the lower end of the leg.

3. A self-retaining glide-for a lower end of a leg of a walker comprising:

a molded elongated main member having first and second spaced tubular supports extending orthogonally from one surface of said main member, said main member being generally flat prior to installation of said glide;

said first and second tubular supports each sized in diameter for snug slidable engagement onto the lower end of the leg;

said first tubular support open at each end thereof and positioned adjacent a first end of said main member, said second tubular support open at a distal end thereof and having a closed bottom end defined by a portion of said one surface adjacent a second end of said main member;

a plurality of spaced parallel elongated fins positioned and extending orthogonally from another surface of said main member opposingly from said second tubular support;

said plurality of fins defining a lower ground or carpet engaging surface;

said main member having a semi-flexible central portion between said first and second tubular supports which is resiliently flexible into a generally U-shape for installation of said glide onto the lower end of the leg.

* * * * *